US006733332B1

(12) United States Patent
Espenshade et al.

(10) Patent No.: US 6,733,332 B1
(45) Date of Patent: May 11, 2004

(54) ELECTRICAL CONNECTOR WITH IMPROVED SHELL

(75) Inventors: Leonard K. Espenshade, Harrisburg, PA (US); Yakov Belopolsky, Harrisburg, PA (US); Kevin E. Walker, Hershey, PA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/375,789

(22) Filed: Feb. 25, 2003

(51) Int. Cl.[7] ..... H01R 13/648
(52) U.S. Cl. ..... 439/541.5; 439/608; 439/607
(58) Field of Search ..... 439/541.5, 607, 439/608, 609

(56) References Cited

U.S. PATENT DOCUMENTS 5,531,612 A 7/1996 Goodall et al.
6,162,089 A 12/2000 Costello et al.
6,183,292 B1 2/2001 Chen et al.
6,319,051 B1 11/2001 Chang et al.
6,350,152 B1 * 2/2002 Belopolsky et al. ..... 439/541.5
6,368,151 B1 * 4/2002 Chen et al. ..... 439/541.5
6,394,846 B1 * 5/2002 Belopolsky et al. ..... 439/620
6,520,799 B1 * 2/2003 Cheng et al. ..... 439/541.5

* cited by examiner

*Primary Examiner*—Gary Paumen
*Assistant Examiner*—James R. Harvey
(74) *Attorney, Agent, or Firm*—Wei Te Chung

(57) ABSTRACT

An electrical connector (1) has a metal shell (2), a main housing (6), a pair of LEDs (5) received in the main housing, a subassembly (7) assembled to the main housing, a stacked Universal Serial Bus (USB) 4, and a plastic part (8) assembled to the subassembly. The shell has a pair of side walls (21), a top wall (22), a front wall (23) and a shielding plate (231) extending rearwardly from the front wall. The main housing has a partitioner (64) dividing an interior space thereof into a first and second receiving cavities (61, 62). The partitioner defines a channel (641) receiving the shielding plate of the shell.

2 Claims, 6 Drawing Sheets

ELECTRICAL CONNECTOR WITH IMPROVED SHELL

CROSS-REFERENCE TO RELATED APPLICATION

This present application is related to a co-pending U.S. patent application Ser. No. 10/236,615, filed on Sep. 6, 2002, invented by Leonard Kay Espenshade et al., entitled "ELECTRICAL CONNECTOR ASSEMBLY HAVING GROUND MEMBER" and assigned to the common assignee.

BACKGROUND OF THE INVENTION

1. Field of the Invention

The present invention generally relates to electrical connectors, and more particularly to an electrical connector having an improved shell to ensure a good signal transmission quality.

2. Description of the Prior Art

Personal computer manufactures utilize RJ45 and Universal Serial Bus (USB) connector in various combination in their desktop, laptop and related computer product. But those separate components each has its own housing and structural and requires relative more space, thus integration of RJ45 and USB is demanded in computer design.

U.S. Pat. No. 6,183,292, issued on Feb. 6, 2001 and assigned to the same assignee as the present invention, discloses a conventional shielded modular jack. The modular jack has a dielectric frame, a daughter board having a RJ45 connector and a transformer mounted thereon, a staked USB connector, and a first and second shields enclosing the frame and the daughter board. The USB connector has a grounding shell mounted on a rear portion thereof. The frame has a horizontal partitioner and a vertical partitioner separating an interior space of the frame into a first and second spaces. The RJ45 and the USB connector are respectively received in the first and second spaces. However, as the modular jack includes the first and second shields and the rear shield attached to the USB connector to prevent EMI (Electromagnetic Interference), such a structure militates against a simple assembling process and a low cost.

U.S. Pat. No. 6,162,089, issued on Dec. 19, 2000 and assigned to Costello et al., discloses a stacked LAN connector. The connector comprises a main body, a modular jack, a USB, a rear shield disposed between the modular jack and the USB, and an integral shield enclosing the main body, the modular jack and the USB. However, the rear shield and the integral shield are separably manufactured and assembled to the main body, which adds the complexity of process of producing and assembling.

U.S. Pat. No. 5,531,612, issued on Jul. 2, 1996 and assigned to Goodall et al., discloses a multi-port modular jack assembly. The modular jack comprises a first and second rows of modular jacks mounted within a common main housing surrounded by external shielding. The first and lower rows are in a substantially mirror-image disposition, a mid-shield is positioned between the first and second rows of the modular jacks for reducing cross-talk interference therebetween. The mid-shield has a first plate portion received in a slot defined in the main housing and a second plate portion abutting the rear face of the main housing. However, in assembly process, the mid-shield is inserted into the slot first and the external shielding is assembled to the main housing thereafter, thus a simplified assembly process is not easily achieved.

Hence, an improved connector is needed to eliminate the above mentioned defects of the conventional connectors.

BRIEF SUMMARY OF THE INVENTION

The object of the present invention is to provide an electrical connector having a better shell shielding from electromagnetic interference (EMI) and suppressing cross-talk therebetween.

An electrical connector of a preferred embodiment of the present invention has an insulative main housing, a pair of light emitting devices (LEDs), a subassembly assembled to the main housing, a stacked Universal Serial Bus connector (USB), a plastic part assembled to the subassembly, and a metal shell. The main housing has a partitioner dividing an interior space thereof into a first and second receiving cavities. The partitioner defines a channel extending therethrough in a horizontal direction. The metal shell has a top wall, a pair of side walls and a front wall. The front wall has a beam section and a shielding plate extending rearwardly from and substantially perpendicularly to the beam section. The shielding plate is received in the channel of the main housing.

Other objects, advantages and novel features of the invention will become more apparent from the following detailed description of a preferred embodiment when taken in conjunction with the accompanying drawings.

DETAILED DESCRIPTION OF THE INVENTION

Figure 1:
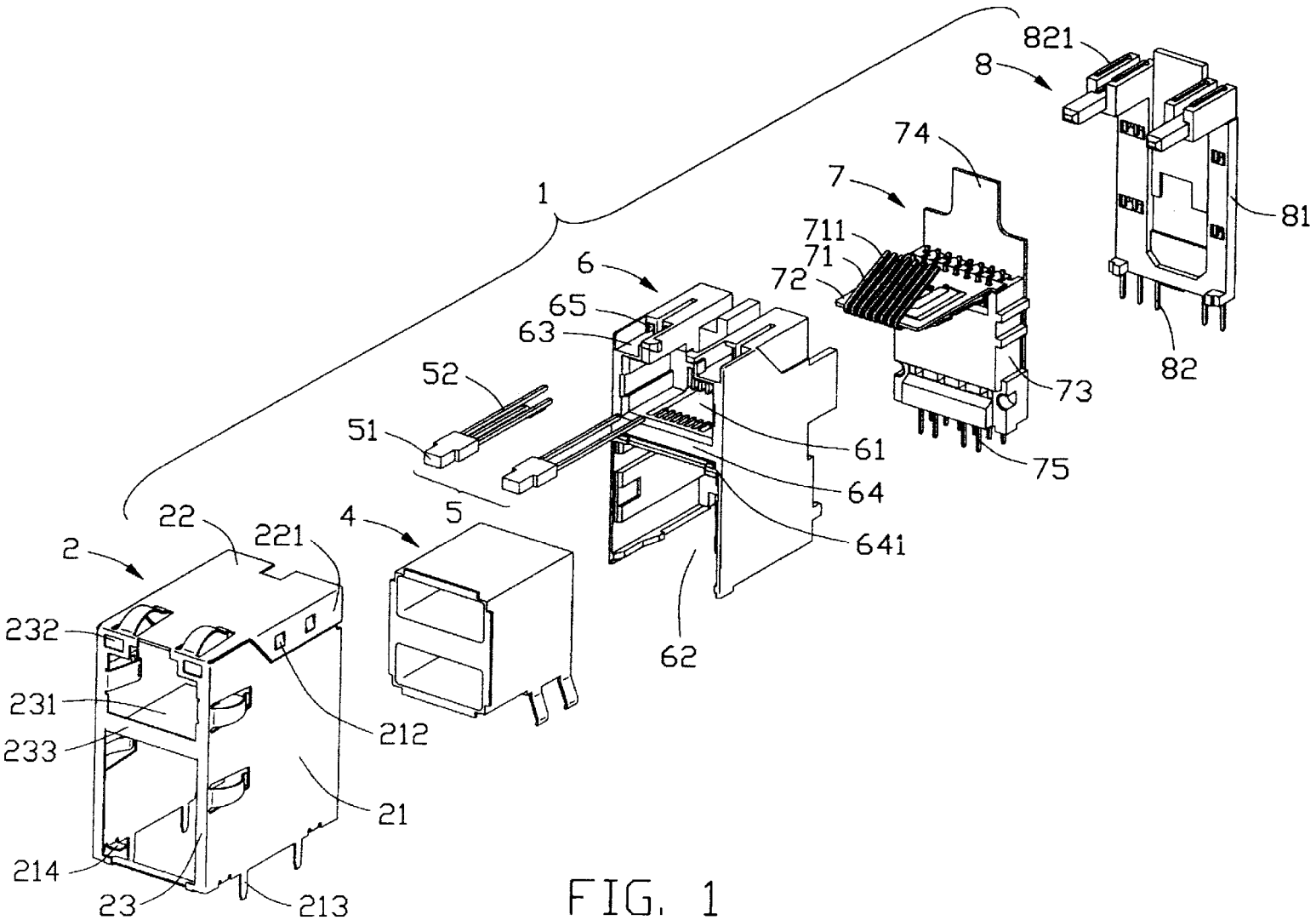
FIG. 1 is an exploded view of a preferred embodiment of the present invention.
Figure 2:
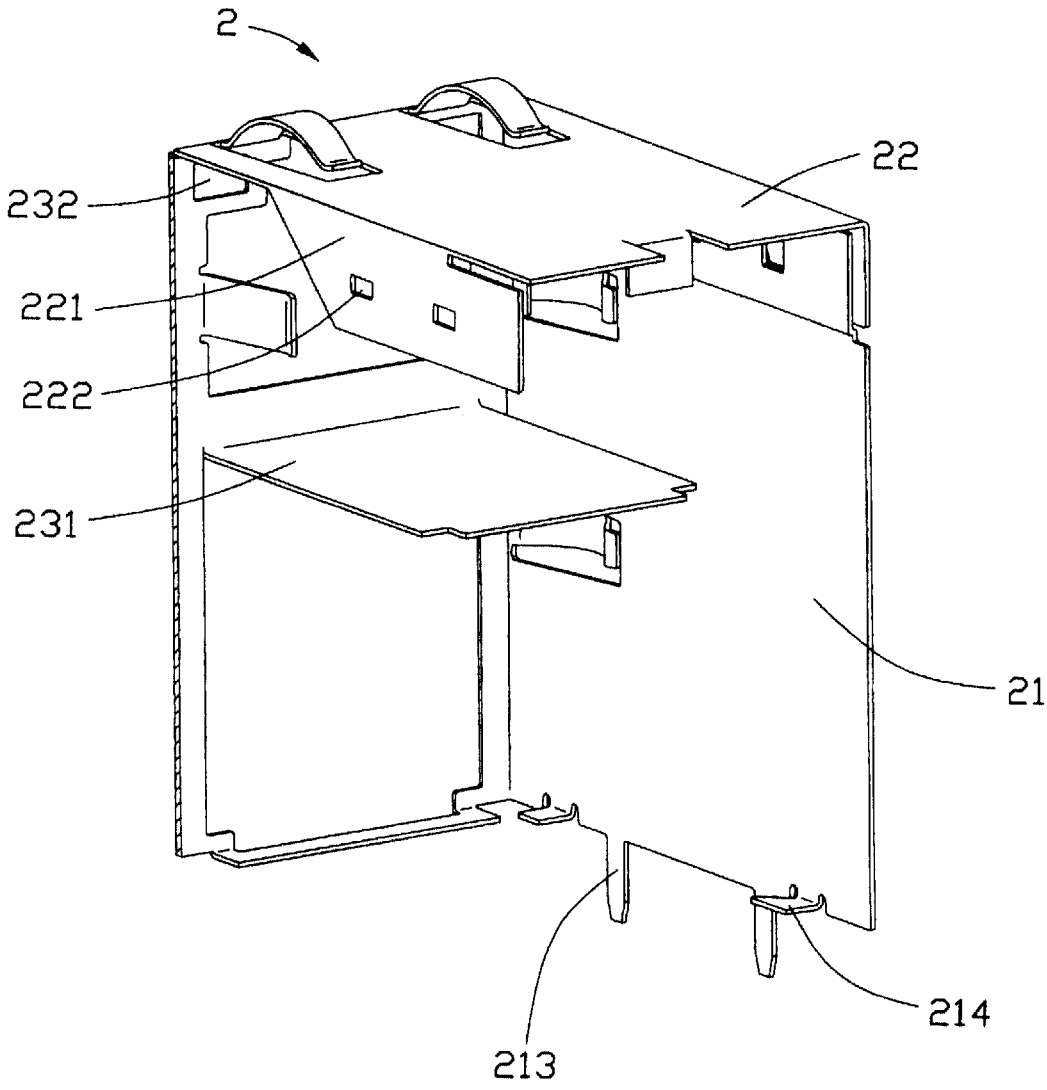
FIG. 2 is a perspective view of a shell of the preferred embodiment.
Figure 3:
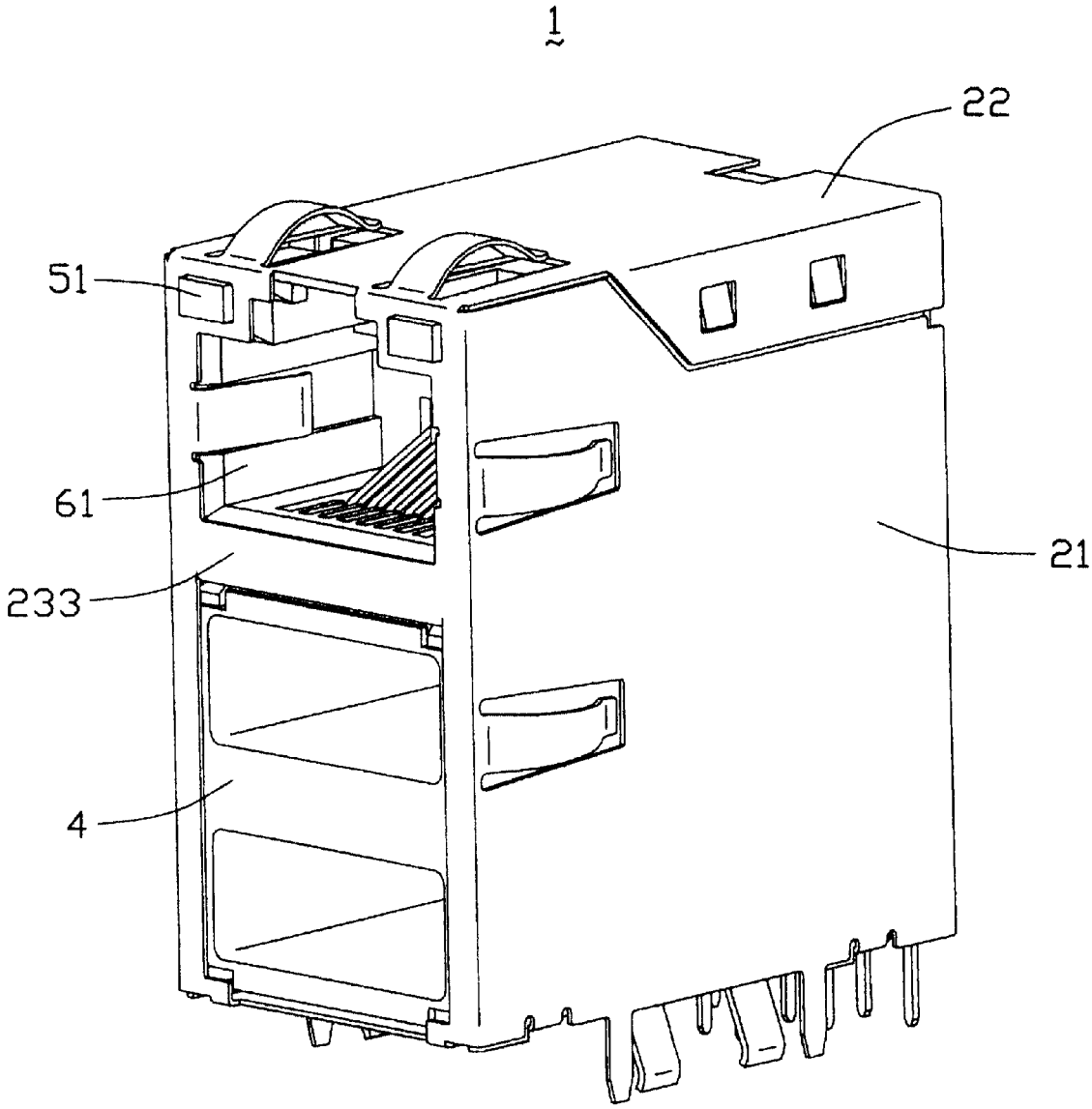
FIG. 3 is a perspective view of FIG. 1.

Referring to FIGS. 1 and 2, an electrical connector 1 of a preferred embodiment of the present invention has a shell 2, a main housing 6, a pair of light-emitting devices (LEDs) 5, a stacked Universal Serial Bus connector (USB) 4, a subassembly 7, and a plastic part 8.

The shell 2 has a pair of side walls 21, a top wall 22 and a front wall 23. Each side wall 21 forms a pair of latches 212 on a top portion thereof and a plurality of grounding tabs 213 and retentive tabs 2314 at a bottom portion thereof. The top wall 22 has a pair of flat portions 221 respectively extending downwardly from opposite side edges of the top wall 22 and two pairs of fixing holes 222 respectively defined in the flat portions 221. The front wall 23 has a pair of receiving slots 232 defined adjacent to a top portion thereof and a beam section 233 connecting front edges of the pair of side walls 21. The beam section 233 has a shielding plate 231 bending rearwardly therefrom and perpendicular thereto. The shielding plate 231 divides an interior space (not labeled) of the shell 2 into an upper cavity (not labeled) and a lower cavity (not labeled).

Figure 4:
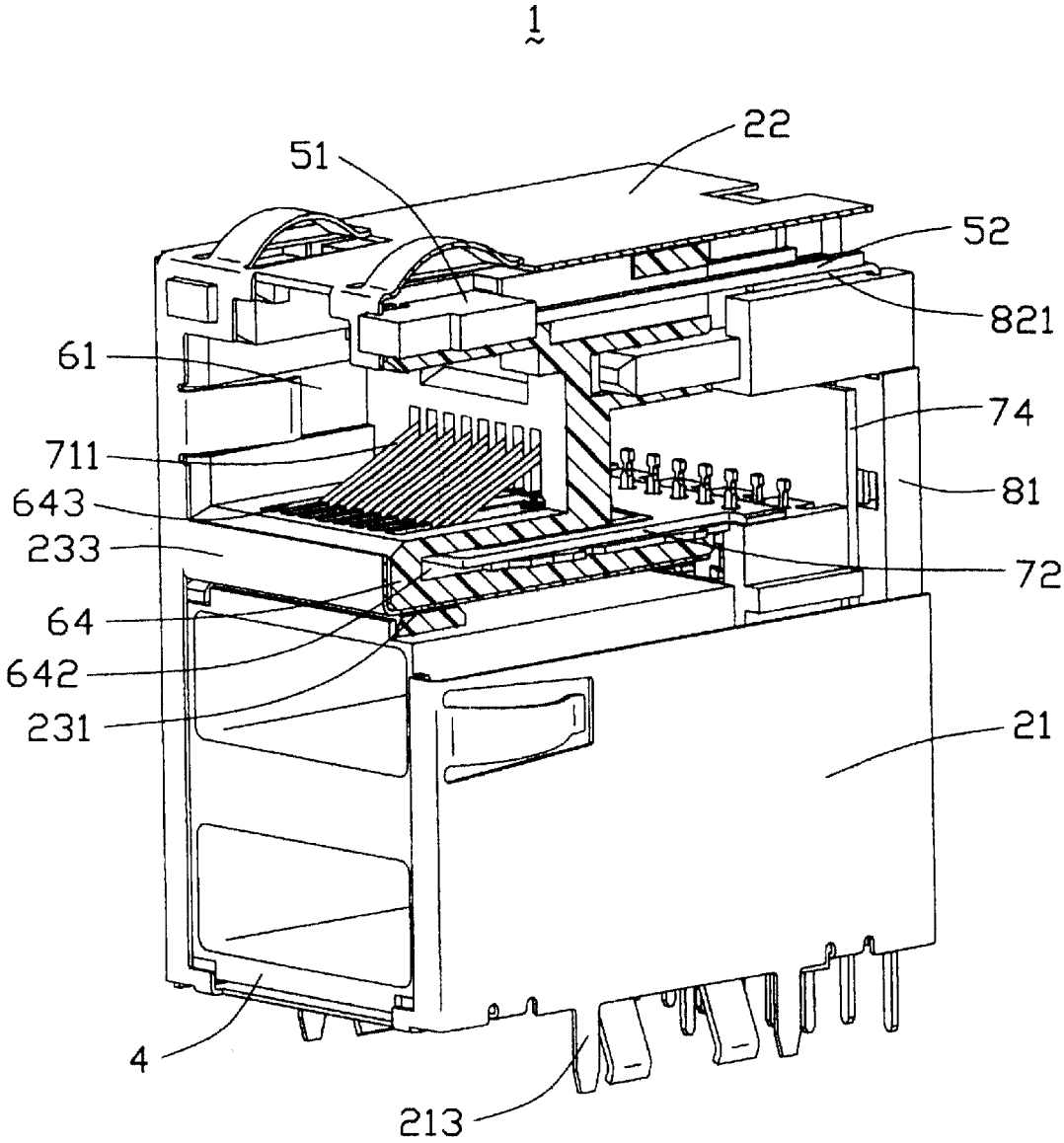
FIG. 4 is a cutaway view of FIG. 3.

The main housing 6 is substantially a cubic and has a partitioner 64 separating an interior space (not labeled) thereof into a first receiving cavity 61 and a second receiving cavity 62. The main housing 6 defines a pair of grooves 63 on a top wall (not labeled) thereof and respectively adjacent to corresponding side walls (not labeled) and a plurality of passageways 65 respectively communicating with the grooves 63. Referring to FIG. 4, the partitioner 64 defines a channel 641 extending therethrough from a front edge to a rear edge, a receiving passage 642 above the channel 641 extending from the rear edge toward the front edge, and a plurality of recesses 643 on a top wall (not labeled) thereof respectively communicating with the receiving passage 642.

Each LED 5 has a lumining portion 51 and a plurality of leads 52 extending from the lumining portion 51.

Referring to FIGS. 1–2, the subassembly 7 has a magnetic module 73, an internal printed circuit board (PCB) 72 attached onto the magnetic module 73, a vertical PCB 74 attached to a rear wall (not labeled) of the magnetic module 73, a plurality of terminals 71 electrical connecting with the internal PCB 72, and a plurality of contacts 75 received in the magnetic module 73. The terminals each has a contacting section 711, and some of the contacts 75 electrically connect with the internal PCB 72. The magnetic module 73 defines a cavity (not shown) receiving magnetic coils (not shown).

The plastic part 8 has a plate portion 81 and a plurality of contact elements 82 insert molded therein. The plate portion 81 has a pair of supporting posts (not labeled) extending from a top edge thereof, and each contact element 82 forms a contacting portion 821 abutting against a corresponding supporting post of the plate portion 81.

Referring to FIGS. 1–4, in assembly, the LEDs 5 are received in the grooves 63 of the main housing 6 with the lumining portions 51 thereof exposed to a front wall (not labeled) of the main housing 6 and the leads 52 thereof received in the passageways 65 of the main housing 6. The subassembly 7 is assembled to the main housing 6 from a rear edge of the main housing 6, the internal PCB 72 is received in the receiving passage 642 and the terminals 71 are received in first receiving cavity 61 by extending through corresponding recesses 643. The USB 4 is received in the second receiving cavity 62 of the main housing 6. The plastic part 8 is assembled to the vertical PCB 74 of the subassembly 7, free ends of the supporting posts thereof are received in corresponding receiving holes (not labeled) of the main housing 6 and the contacting portions 821 of the contact elements 82 electrically connect with the leads 52 of the LEDs 5.

The shell 2 is assembled to the main housing 6 from front edge of the main housing 6, the lumining portions 51 of the LEDs 5 are received in the receiving slots 232 of the shell 2, and the shielding plate 231 of the shell 2 is received in the channel 641 of the main housing 6. The beam section 233 of the shell 2 abuts against a front edge of the partitioner 64 of the main housing 6. The retentive tabs 214 of the shell 2 respectively abut against a bottom edge of the main housing 6 and a bottom wall of the USB 4. The fixing holes 222 of the top wall 22 engage with corresponding latches 212 of the side walls 21.

In use, the electrical connector 1 is disposed on a PCB of a peripheral equipment (not shown), the grounding tabs 213 engaging with the PCB of the peripheral equipment, the contacts 75 received in a bottom portion of the subassembly 7 engage with proper circuit traces of the PCB of the peripheral equipment, and the grounding tabs 213 electrically connect with grounding circuit traces of the PCB of the peripheral equipment.

Figure 5:
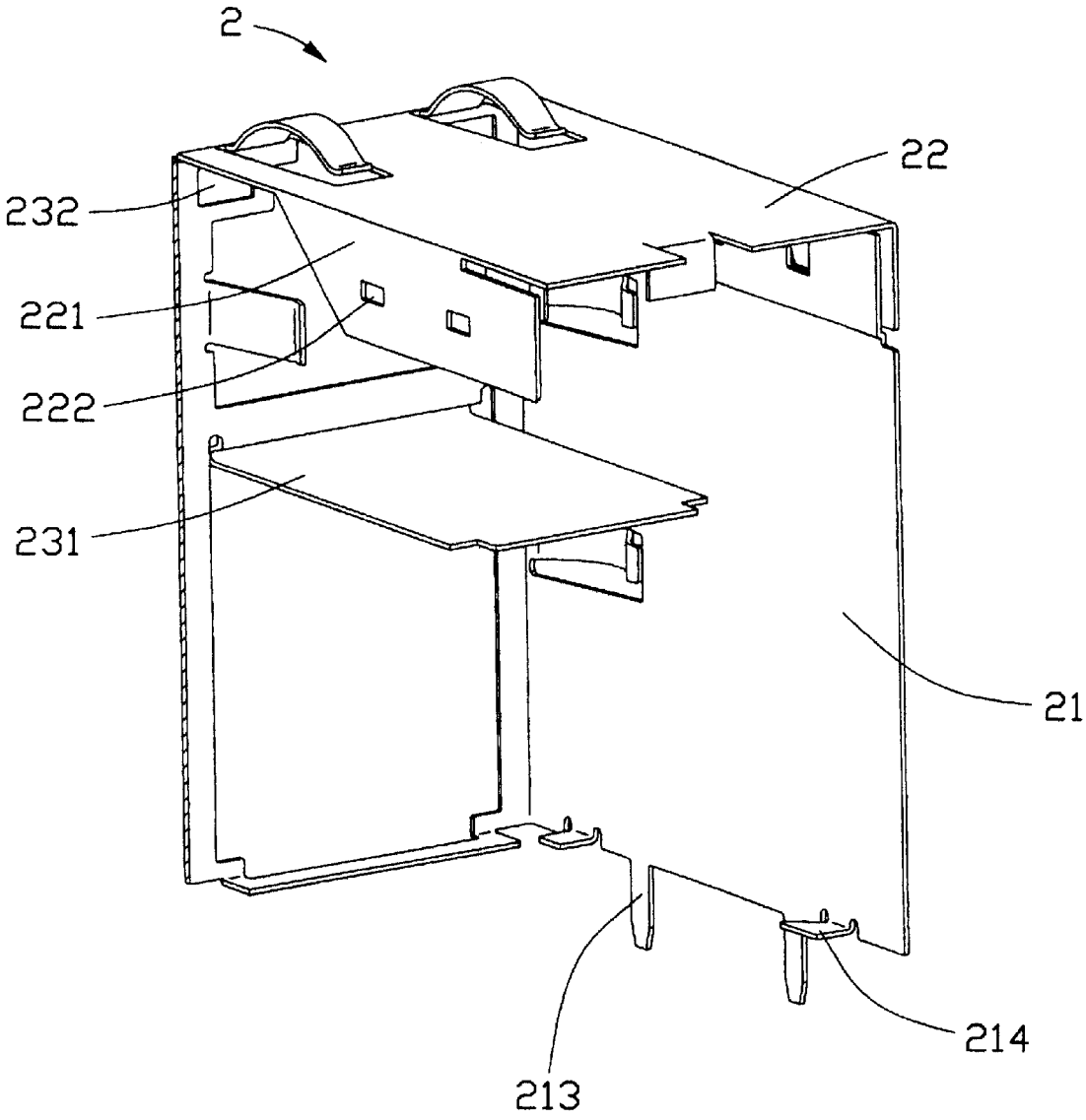
FIG. 5 is a perspective view of a shell of another embodiment of the present invention.
Figure 6:
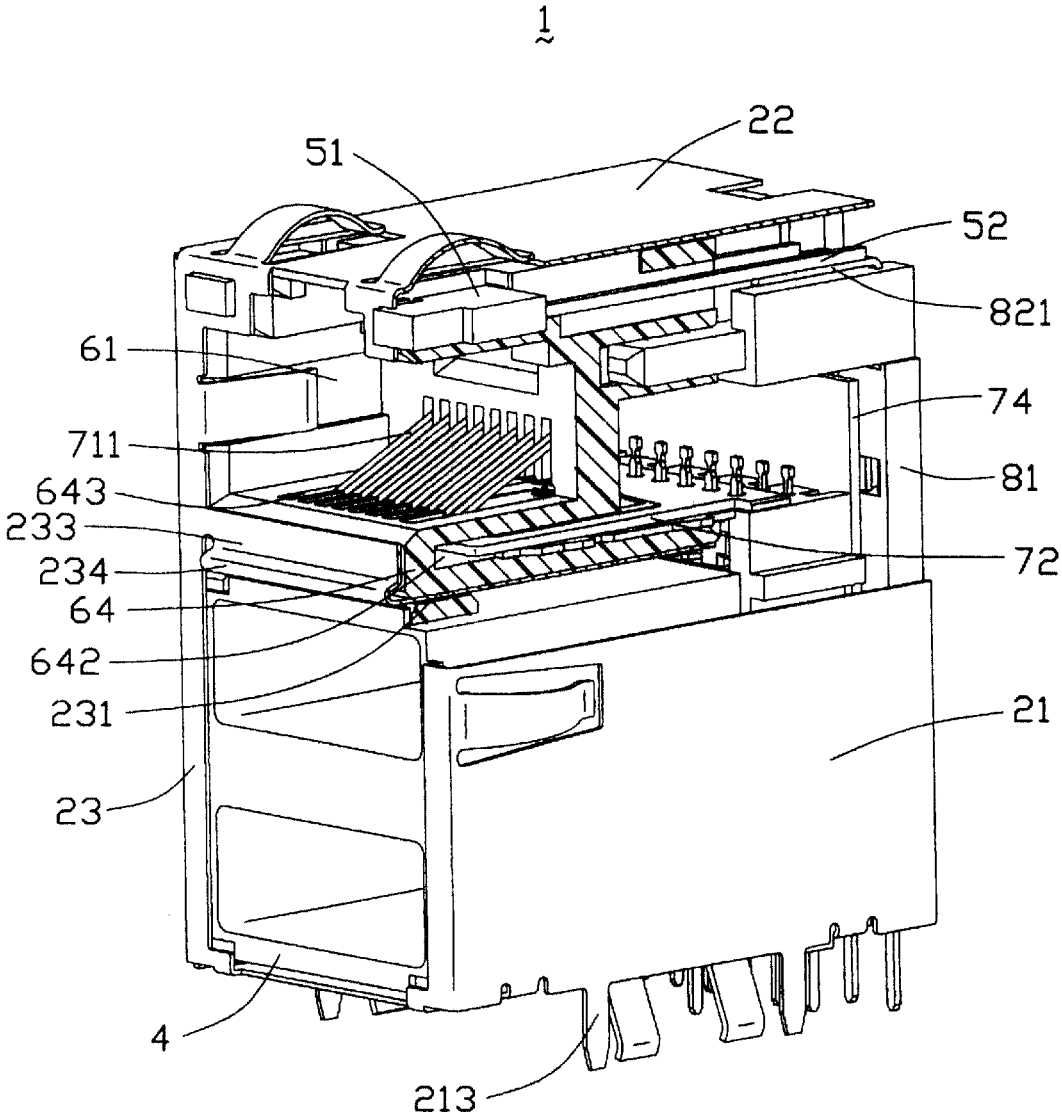
FIG. 6 is a cutaway view of the second embodiment of the present invention.

FIGS. 5–6 show another embodiment of the shell 2. A front wall 23 of the shell 2 forms a beam section 233, a flexible section 234 extending downwardly and forwardly from the beam section 233, and a shielding plate 231 bending rearwardly from the flexible section 234. As the flexible section 234 is formed between the beam section 233 and the shielding plate 231, thus the flexible section 234 contacts the equipment chassis when the electrical connector 1 is assembled into a peripheral equipment (not shown), the flexible section 234 moves in a reverse direction when an outer force is exerted thereon.

The shielding plate 231 of the present invention can also be manufactured individually. The beam section 233 is a curved shape, and the flexible section 234 of the shielding plate 231 electrically connects with the beam section at the curved portion of the beam section 233.

An advantage of the present invention over the prior art is that the shielding plate 231 divides the interior space of the shell 2 into the upper and lower cavities for respectively shielding the USB 4 and the plurality of the terminals 71. As a result, the cross-talk between signals transmitted by the terminals 71 and the USB 4 is remarkably reduced. Furthermore, the shielding plate is integrally made from the shell 2, thus the processes of manufacturing and assembling are less complicated.

It is to be understood, however, that even though numerous, characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a main housing having a partition dividing an interior space thereof into a first and second cavities, the partition defining a channel extending there through;

a plurality of terminals received in at least one of the cavities of the main housing; and an integral shield attached to the main housing, the shield having a shielding plate received in the channel of the main housing for suppressing electromagnetic interference (EM1) and cross-talk between the two cavities;

wherein the shield has a front wall, the front wall has a beam section and the shielding plate extends rearward from a bottom edge of the beam section, and a distal end of said shielding plate is closer to a rear portion of the connector than a front portion of the connector;

wherein the electrical connector has a subassembly, the subassembly has an internal printed circuit board (PCB), the terminals electrically connect with the internal PCB;

wherein the partition of the main housing defines a receiving passage receiving the internal PCB of the subassembly;

wherein the partition of the main housing further defines a plurality of recesses on a top wall thereof receiving corresponding terminals of the subassembly.

2. An electrical connector comprising:

a main insulative housing defining a front face with a partition extending rearwardly from a middle portion of the front face to divide an interior space into first and second cavities;

a plurality of terminals located in at least one of said first and second cavities;

a unitary metallic shield attached to the housing, and defining at least a front wall circumferentially covering said front face while with at least two large openings therein to expose said first and second cavities, respectively;

said shield defining a beam section between said two large openings;

a grounding plate integrally extending rearwardly from an edge of said beam section with a significant distance and in a parallel relationship with the partition, wherein said grounding plate is dimensioned, along a lengthwise direction thereof, to be similar to one of sid opening said edge confronts, and a distal end of said grounding plate is closer to a rear portion of the connector than a front portion of the connector.

* * * * *